United States Patent [19]

Campbell

[11] 4,398,901

[45] Aug. 16, 1983

[54] DIVIDER BOX ASSEMBLY SYSTEM

[75] Inventor: Frederick R. Campbell, Cloverdale, Calif.

[73] Assignee: Crown Zellerbach Corporation, San Francisco, Calif.

[21] Appl. No.: 244,447

[22] Filed: Mar. 16, 1981

[51] Int. Cl.[3] ..... B31B 11/02

[52] U.S. Cl. ..... 493/90; 493/334; 493/167; 493/912

[58] Field of Search ..... 493/90, 89, 92, 912, 493/334, 167, 309, 169

[56] References Cited

U.S. PATENT DOCUMENTS

| | | | |
|---|---|---|---|
| 3,134,308 | 5/1964 | Ali-Oglu | 493/92 |
| 3,541,930 | 11/1970 | Goodrich | 493/167 |
| 3,659,505 | 5/1972 | Wasyluka | 493/169 |
| 4,154,148 | 5/1979 | Weremiczyk | 493/90 |
| 4,235,158 | 11/1980 | Johnson, Jr. | 493/334 |
| 4,235,159 | 11/1980 | Johnson, Jr. | 493/309 |
| 4,283,188 | 8/1981 | Wintergerter | 493/89 |

*Primary Examiner*—Nicholas P. Godici
*Assistant Examiner*—K. Rowan
*Attorney, Agent, or Firm*—Thomas R. Lampe

[57] ABSTRACT

System for assembling a divider box from a main body blank, separate end panels and at least one divider panel. The end and divider panels are delivered to a container-erecting station where the panels are secured to the main body blank while the container is being erected.

2 Claims, 11 Drawing Figures

DIVIDER BOX ASSEMBLY SYSTEM

BACKGROUND OF THE INVENTION

1. Field of Invention

This invention relates to a system for assembling a divider box or container from a plurality of box components, namely a main body blank including a bottom wall and side walls, separate end panels and at least one divider panel. The end panels and divider panel are substantially simultaneously delivered to a container-erecting station, at which location they are secured to the main body blank while the container is being erected.

2. Description of the Prior Art

Wasyluka et al. U.S. Pat. No. 3,659,505, issued May 2, 1972, is directed to apparatus and a method for erecting containers from three separate blanks, namely a main body blank and separate end panels. The container produced thereby is commonly known in the art as a "Bliss-style" box. Other known apparatus for erecting Bliss-style containers from three-piece blanks are disclosed, for example, in Roesner U.S. Pat. Nos. 3,342,116 and 3,456,563, issued in September, 1967 and July, 1969, respectively.

The system disclosed herein also relates to the formation of a Bliss-style container, and in particular to construction of such container incorporating one or more divider panels therein. The divider panels are introduced into and attached to the rest of the box at the time of erection and formation thereof. While adhesively secured divider panels per se are known in the prior art they have conventionally been introduced into and affixed to the remainder of the box after it has been erected and wholly or partially assembled. These prior art box assembly systems therefore conventionally require the use of separate box erection equipment prior to complete assembly thus adding to the expense and complexity of the equipment. It will also be appreciated that such prior art systems require accurate transport, manipulation and placement of the erected outer portion of the box when the divider pads are introduced and secured therein. This further contributes to the complexity and expense of prior art divider box assembly equipment. Examples of such prior art systems are those disclosed in Ali-Oglu U.S. Pat. No. 3,134,308, issued May 26, 1964, Johnson U.S. Pat. No. 4,235,158, issued Nov. 25, 1980 and Johnson et al. U.S. Pat. No. 4,235,159, issued Nov. 25, 1980. The box produced in accordance with the teachings of the present invention is characterized by its superior stacking strength.

BRIEF SUMMARY OF THE INVENTION

The present invention relates to an apparatus and method for erecting a container from a main body blank including a bottom wall and side walls, separate end panels and at least one divider panel. The main body blank is positioned at a predetermined location relative to a container-erecting station including container-erecting elements. A reciprocating forming mandrel moves in and out of the container-erecting station and cooperates with the container-erecting elements to erect and form the container. The mandrel forces the main body blank into the container-erecting station at the same time that it delivers end panels and divider panels thereto. The panels are all adhesively secured to the main body blank during the container-erecting step. Tabs incorporated in the end panels and divider panels are bent prior to entry of the panels into the container-erecting station and are secured to the main body blank side walls.

DETAILED DESCRIPTION

Figure 1:
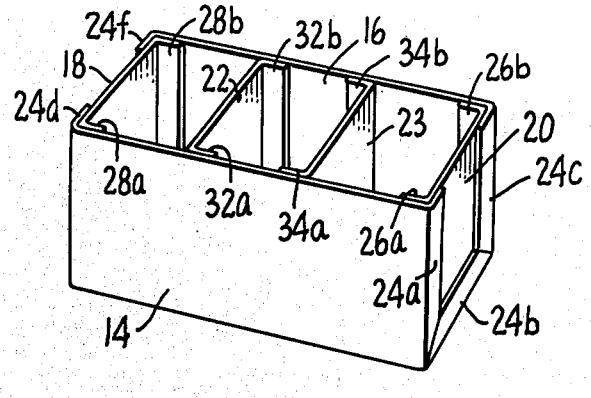
FIG. 1 is a perspective view of one form of container constructed by the present system.
Figure 2:
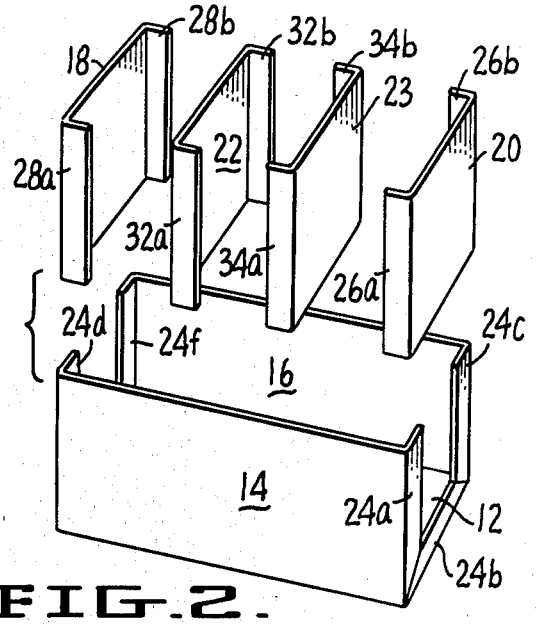
FIG. 2 is a view similar to FIG. 1 but exploded to show the individual components of the container.
Figure 3:
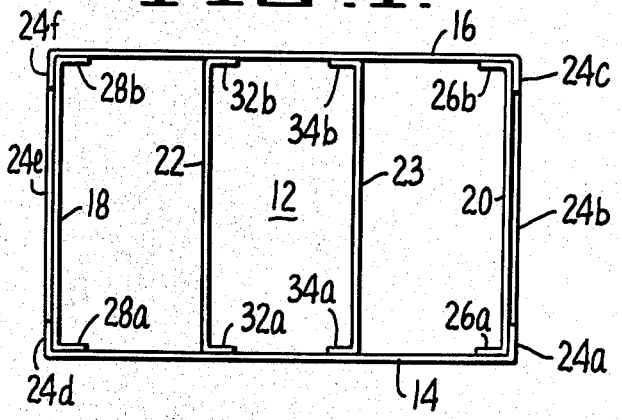
FIG. 3 is a plan view of the container shown in FIG. 1 illustrating details of the construction thereof.

FIGS. 1–3 illustrate a container of the type constructed by the apparatus and according to the method of the present invention. The container is formed from a main body blank including a bottom wall 12 and side walls 14 and 16. The container also includes end panels 18, 20 and divider panels 22, 23. Connector flaps 24*a* through 24*f* depend from the bottom and side walls and are secured to end panels 18 and 20 by a suitable adhesive. In the illustrated embodiment tabs 26*a*, 26*b* and 28*a*, 28*b* are incorporated in end panels, 18, 20, respectively, and are secured by a suitable adhesive to side walls 14 and 16. Likewise, divider panels 22 and 23 incorporate tabs 32*a*, 32*b* and 34*a*, 34*b*, respectively, said tabs being integral with the main divider panel and secured by a suitable adhesive to the side walls 14 and 16.

Figure 9:
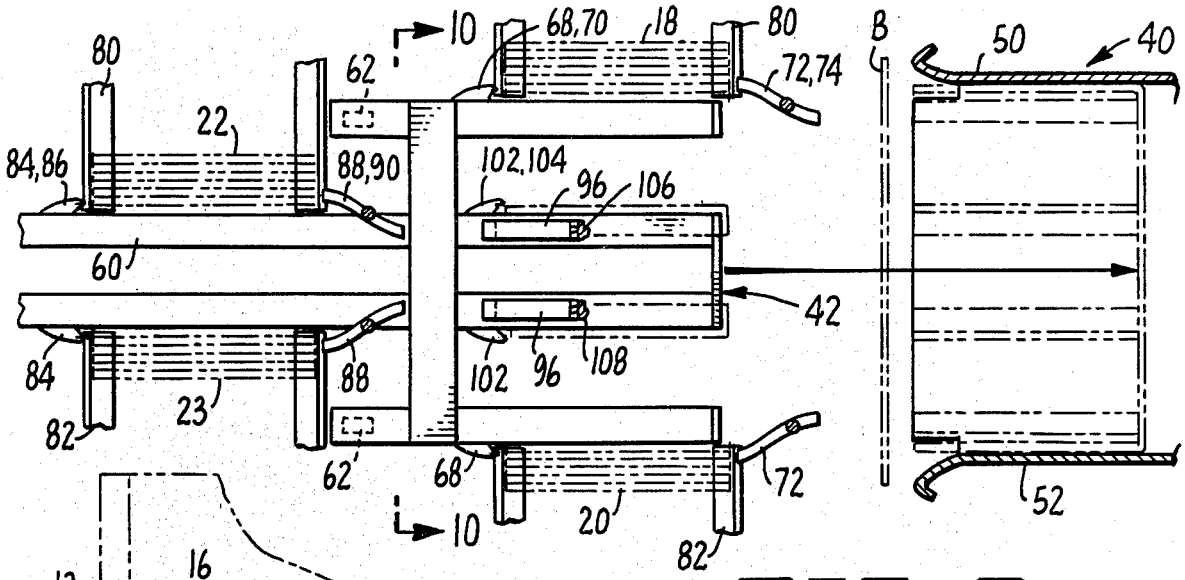
FIG. 9 is a plan view of selected portions of the mandrel and container-erecting station prior to container assembly.
Figure 10:
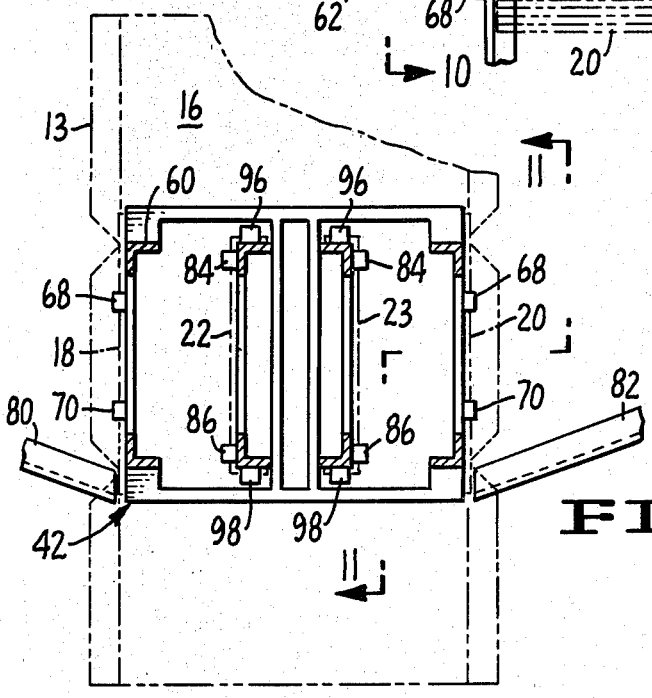
FIG. 10 is a cross-sectional view along line 10—10 of FIG. 9.
Figure 11:
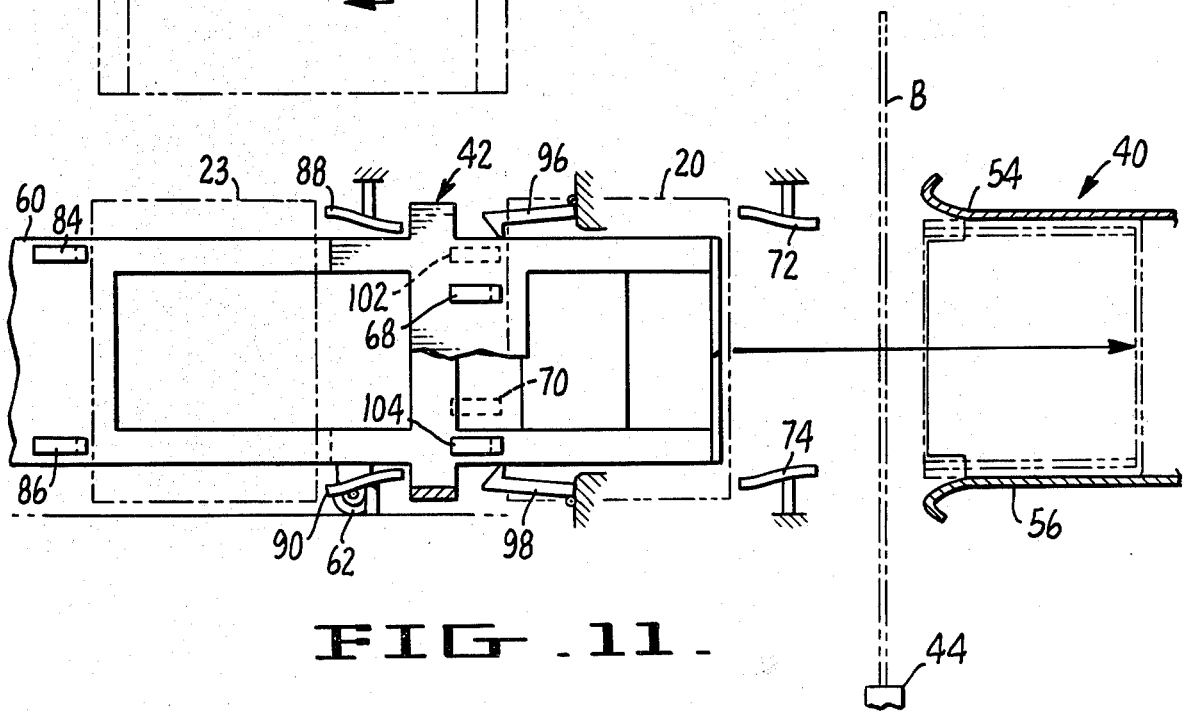
FIG. 11 is a cross-sectional view taken along line 11—11 in FIG. 10.

Apparatus used to constrct a container the same or similar to that shown in FIGS. 1–3 is illustrated in FIGS. 9–11. The apparatus has a number of features common to that disclosed in Wasyaluka U.S. Pat. No. 3,659,505, issued May 2, 1972, and such patent is incorporated herein by reference. For the sake of simplicity certain features referred to herein have not been illustrated because they are already adequately described in detail in U.S. Pat. No. 3,659,505. The apparatus of the present invention in common with that shown in U.S. Pat. No. 3,659,505 incorporates a container-erecting station 40 and a forming mandrel 42 cooperable therewith to erect and form a completed container. A main body blank formed of bottom wall 12, side walls 14, 16 and their associated connector flaps is positioned between container-erecting station 40 and mandrel 42 at a main body blank-receiving station disposed between the container-erecting station and forming mandrel. During the operation of the apparatus individual blanks B are fed into the main body blank-receiving station by any suitable mechanism such as that shown, for example, in U.S. Pat. No. 3,659,505, so that the individual blanks are supported on edge on a suitable supporting surface 44.

A suitable drive mechanism, again as for example that disclosed in U.S. Pat. No. 3,656,505, causes the forming mandrel 42 to be reciprocally movable between an outer position whereat the leading end of the forming mandrel is positioned on the opposite side of the main body blank-receiving station from the container-erecting station to an inner position within the container-erecting station. As is shown in detail in U.S. Pat. No. 3,659,505 such movement results in the mandrel driving the body blank B into the container-erecting station whereat the mandrel and container-erecting elements of the station will cause the side walls of the blank to be bent 90° relative to the bottom wall thereof. The container-erecting elements comprise a plurality of plates 50, 52, 54 and 56 which define, in essence, a cavity for receiving the mandrel and erecting the sidewalls of the container about the mandrel. The plates also serve to fold connector flaps 24*a–f* of the main body blank to bring the connector flaps into engagement with end panels introduced into the container-erecting station at the time of container formation to form the rectangularly figured box. It will be appreciated that adhesive will be positioned between the end panels and the connector flaps to maintain the structural integrity of the container and an appropriate method of accomplishing this is to apply adhesive to the connector flaps as the main body blank B is being delivered to the main body blank-receiving station. Further details of such an approach are set forth in U.S. Pat. No. 3,659,505.

Figure 8:
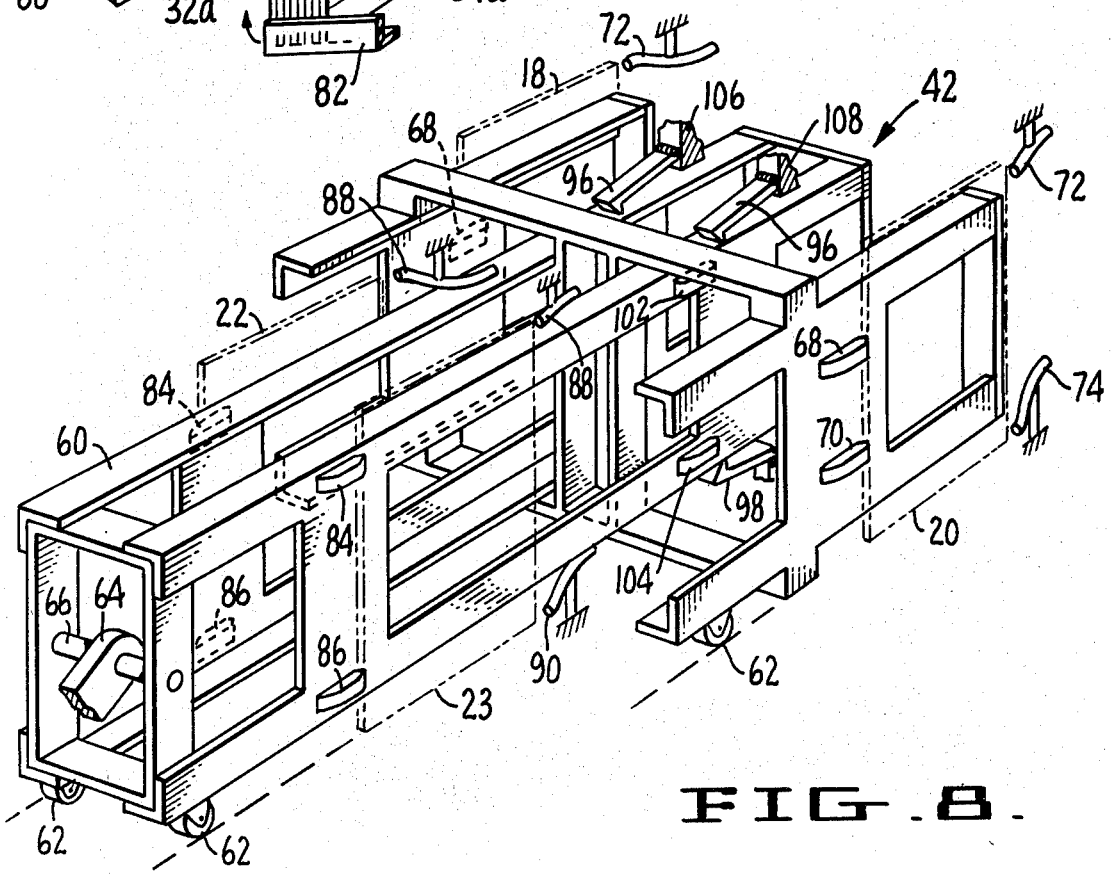
FIG. 8 is perspective view of the mandrel and container-erecting station.

As may perhaps best be seen with reference to FIG. 8, forming mandrel 42 is in the general form of an open framework 60 comprised of structural steel members welded or otherwise secured together. The framework is supported by rollers 62 on suitable support track means (not shown) so that the mandrel is free to reciprocate. A drive arm 64 is attached at one end thereof to a transverse bar 66 secured to opposite sides of the mandrel. The other end of drive arm 64 is connected any suitable mechanism to impart the desired movement thereto such as that shown in U.S. Pat. No. 3,659,505.

In common with the mandrel mechanism disclosed in U.S. Pat. No. 3,659,505, mandrel 42 serves to deliver end panels to the container-erecting station upon container erection and formation in the station. For this purpose framework 60 has disposed on both outer sides thereof end panel-carrying means in the form of shoulder elements 68 and 70 which serve to remove single end panels from a suitable supply hopper disposed adjacent to the mandrel as is the case in U.S. Pat. No. 3,659,505. It will be appreciated that as the mandrel moves to the right (as viewed in FIG. 9) shoulder elements 68 and 70 will remove the outermost end panels from the hopper and convey them to the container-erecting station. During such movement plow mechanisms 72, 74 disposed along the path of movement will bend end panel tabs 26*a, b* and 28*a, b* inwardly so that the tabs are positioned over and under the mandrel framework. Thus, when the container is fully erected the end panel tabs will be in face to face engagement with the box side walls. A glue applicator of any desired type (not shown) may be used to apply glue to the end panel tabs after they are bent by the plows and prior to their engagement with the side walls, thus contributing to the structural integrity of the container.

Figure 7:
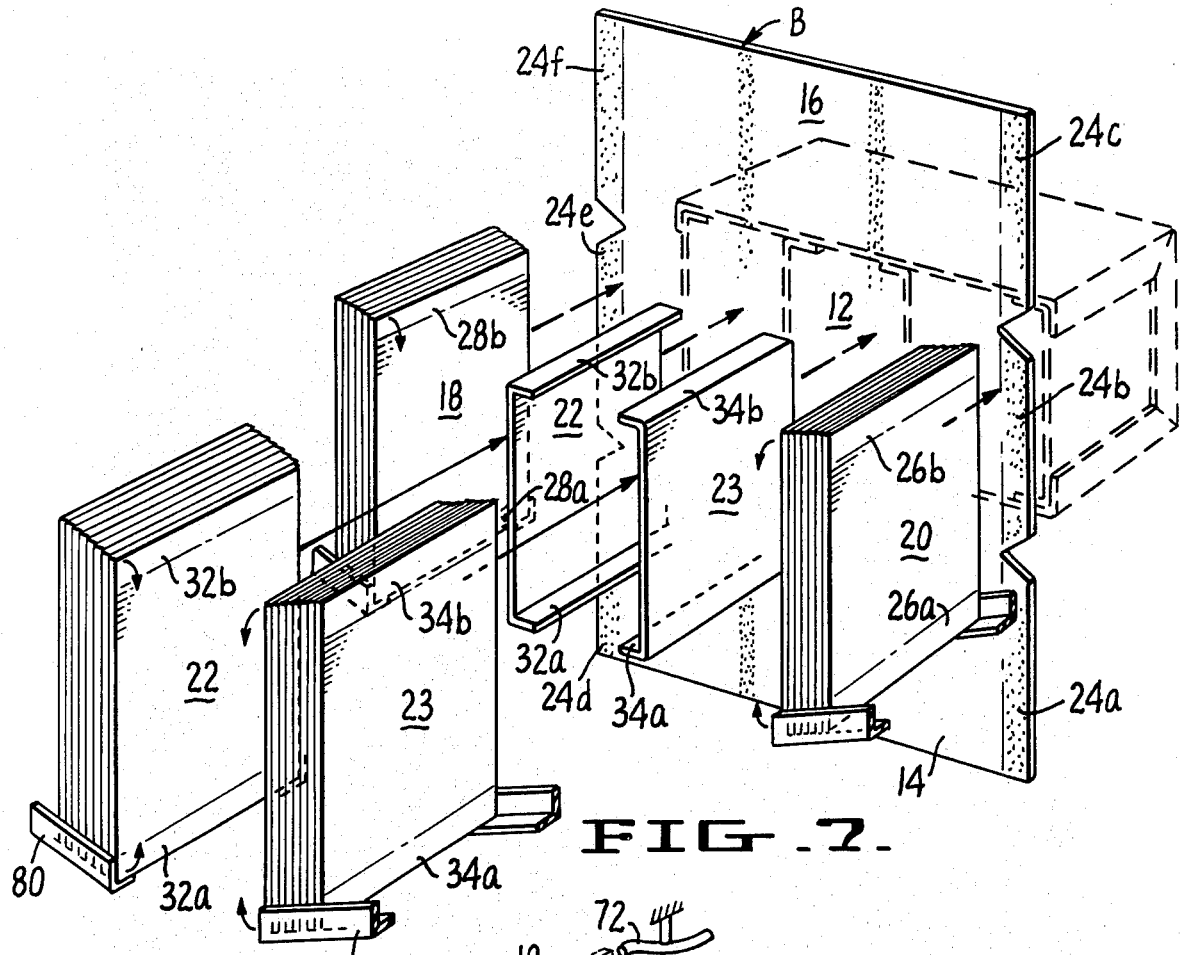
FIG. 7 is a schematic perspective view illustrating the positions assumed by the box components prior to formation of an erected and assembled container.

In addition to conveying the end panels to the container-erecting station, mandrel 42 delivers two divider panels thereto. The end panels are delivered in a single stroke from the end panel hoppers to the container-erecting station. The divider panels are delivered thereto in two steps. As may be seen in FIGS. 7 and 9, the divider panels are disposed in gravity fed hoppers or chutes 80 and 82 positioned to the left of the hopper fed end panels. As the mandrel moves from its left-most position toward the right, shoulder elements 84 and 86 grip the outermost divider panel in each chute and convey it to the right. As each divider panel moves to the right the divider tabs 32*a, b* and 34*a, b* are engaged by fixed plow mechanisms 88 and 90 which bend the divider tabs inwardly toward the top and bottom of the mandrel framework. As the mandrel proceeds to the right the tabs will pass under spring loaded gripper elements 96 and 98. When the mandrel has completed its full movement into the container-erecting station the divider panels will have passed completely under the gripper elements. Thus, when movement of the mandrel is reversed towards the left, the gripper elements will prevent the divider panels from moving toward the left. As the forming mandrel completes its move rearward or towards the left as viewed in FIG. 9, shoulder elements 84 and 86 will again be in position to pick off divider panels from their hoppers or chutes. When the mandrel again resumes movement toward the right and toward the container-erecting station, the second set of divider tabs will be folded and passed under gripper elements 96 and 98 for subsequent retention thereof. At the same time, the first set of divider panels removed from the chutes will be conveyed into the container-erecting station along with a set of end panels. Such conveyance is accomplished by a second set of shoulder elements 102 and 104 which grip the edges of the forwardmost set of divider panels and move them into position during container erection and assembly. It will be noted that the shoulder elements 102 and 104 have tapered cam-like outer surfaces to permit them to pass under a set of divider panels being retained by gripper elements 96 and 98. Just prior to entry of the divider panels into the container-erecting station applicator means of any suitable type may be used to apply adhesive to the divider tabs. Therefore, when the divider tabs come into engagement with the side walls of the main body blank a firm bond therebetween will be established. Rather than apply adhesive to the divider and end panels, the adhesive could be applied to the main body blank prior to box assembly at the locations to be contacted by the panel tabs. FIG. 7 shows adhesive strips on the main body blank to be engaged by the divider tabs, for example. Again, since the adhesive applicator system forms no part of the present invention, it has not been disclosed in detail but applicators such as those disclosed in U.S. Pat. No. 3,152,923 or in the aforementioned Roesner patents may be used. The type of adhesive used will depend, in part, on the speed at which the machine is operated. If blanks are moved rapidly through the container-erecting station it will be desirable to use a fast-setting adhesive of the so-called "hot melt" type, but cold adhesive could be used if the operation is slow enough. It may be desirable to utilize lines of both fast-setting and slower setting adhesive. To ensure that the divider tabs remain generally perpendicular to the main portion of the divider panel while on the mandrel the clearance between the support structure 106 and 108 for the gripper elements should only slightly exceed the thickness of the tabs.

Figure 4:
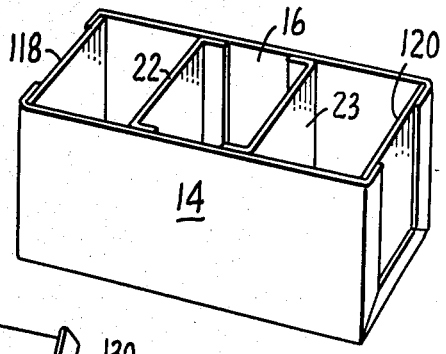
FIGS. 4, 5, and 6 are perspective views illustrating four alternative forms of container that may be constructed using the system of the present invention.
Figure 5:
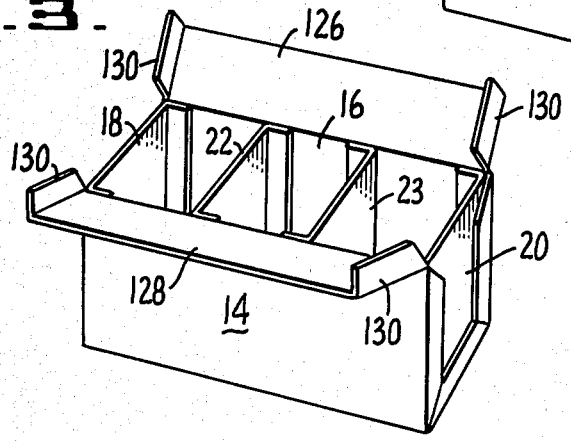
Figure 6:
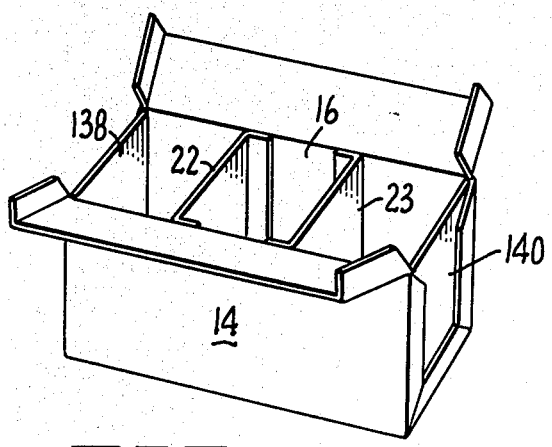

FIG. 4 illustrates another form of box that may be constructed according to the teachings of this invention. The FIG. 4 box embodiment differs from that shown in FIGS. 1–3 only in that the end panels 118 and 120 do not incorporate end panel tabs. The FIG. 5 embodiment differs from that of FIGS. 1–3 in that it employs top wall elements 126 and 128 to the connected side walls. Flaps 130 are connected to the top wall elements and may be glued in position against the outer faces of the end panels to seal the box. FIG. 6 illustrates an arrangement similar to that of FIG. 5 except that the end panels 138 and 140 do not incorporate end panel tabs.

I claim:

1. Apparatus for erecting and assembling a divider container at a single station from a main body blank including a bottom wall and side walls, separate end panels including end panel tabs and at least one divider panel including a main divider panel and divider panel tabs connected to opposed ends of said main divider panel, comprising:

a container-erecting station including container-erecting elements;

a main body blank receiving station adjacent to said container erecting station and including means to position a main body blank at a predetermined location relative to said container-erecting station;

two spaced end panel supply hoppers positioned adjacent to said container erecting station and spaced therefrom;

at least one spaced divider panel supply hopper positioned adjacent to said end panel supply hoppers and spaced therefrom;

a forming mandrel having a leading end and reciprocally movable between an outer position whereat the leading end is positioned on the opposite side of the main body blank-receiving station from the container-erecting station to an inner position within the container-erecting station, said mandrel including end panel receiving means for receiving end panels from said end panel supply hoppers located adjacent to said mandrel and transporting said end panels into said container-erecting station, and said mandrel further including divider panel receiving means for receiving at least one divider panel from said divider panel supply hopper and transporting said divider panel to a location between said end panel supply hoppers and transporting at least one other divider panel from said location into said container-erecting station, said mandrel and said container-erecting elements cooperable to bend said main body blank side walls into engagement with said end panels and divider panels upon formation of said container in said container-erecting station, said apparatus additionally comprising means for bending said divider panel tabs relative to said main divider panel prior to formation of said container in said container-erecting station whereby said mandrel and said container-erecting elements are cooperable to join said divider panel tabs and said side walls in said container-erecting station, and means for bending said end panel tabs relative to the rest of said end panel prior to formation of said container in said container erecting station whereby said divider panel tabs and said end panel tabs are brought into engagement with said side walls in said container-erecting station.

2. The apparatus of claim 1 wherein said mandrel divider receiving means is adapted to receive and transport a plurality of spaced divider panels into said container-erecting station.

* * * * *